US009761970B2

(12) United States Patent
Izawa et al.

(10) Patent No.: US 9,761,970 B2
(45) Date of Patent: Sep. 12, 2017

(54) JACK SOCKET AND ELECTRONIC DEVICE

(71) Applicant: Sony Corporation, Tokyo (JP)

(72) Inventors: Koichi Izawa, Tokyo (JP); Kiyohito Masuda, Tokyo (JP)

(73) Assignees: Sony Corporation, Tokyo (JP); Sony Mobile Communications Inc., Tokyo (JP)

( * ) Notice: Subject to any disclaimer, the term of this patent is extended or adjusted under 35 U.S.C. 154(b) by 0 days.

(21) Appl. No.: 14/541,691

(22) Filed: Nov. 14, 2014

(65) Prior Publication Data

US 2016/0141779 A1 May 19, 2016

(51) Int. Cl.

| | |
|---|---|
| ***H01R 24/04*** | (2006.01) |
| ***H01R 12/70*** | (2011.01) |
| ***H01R 12/72*** | (2011.01) |
| ***H01R 24/58*** | (2011.01) |
| ***H01R 13/46*** | (2006.01) |

(52) U.S. Cl.

CPC ..... *H01R 12/7047* (2013.01); *H01R 12/721* (2013.01); *H01R 13/46* (2013.01); *H01R 24/58* (2013.01); *H01R 2201/06* (2013.01)

(58) Field of Classification Search

CPC H01R 24/58; H01R 2103/00; H01R 2107/00; H01R 13/112

USPC ..... 439/668, 682, 669

See application file for complete search history.

(56) References Cited

U.S. PATENT DOCUMENTS

| | | | | |
|---|---|---|---|---|
| 5,909,063 | A * | 6/1999 | Silliman | H01R 24/46 200/51 R |
| 6,038,766 | A | 3/2000 | Werner | |
| 6,551,127 | B1 | 4/2003 | Li et al. | |
| 6,932,634 | B2 * | 8/2005 | Cooper | H01R 24/46 439/188 |
| 7,044,804 | B2 * | 5/2006 | Han | G02B 6/4292 385/75 |
| 7,326,063 | B1 * | 2/2008 | Raudenbush | H01R 4/64 439/581 |
| 7,371,084 | B2 * | 5/2008 | Xue | H01R 13/652 439/108 |

(Continued)

FOREIGN PATENT DOCUMENTS

| | | |
|---|---|---|
| CN | 2750523 Y | 1/2006 |
| EP | 0 800 232 A2 | 10/1997 |

(Continued)

OTHER PUBLICATIONS

Extended Search Report issued Mar. 6, 2015 in European Patent Application No. 15150490.9.

*Primary Examiner* — Hien Vu

(74) *Attorney, Agent, or Firm* — Oblon, McClelland, Maier & Neustadt, L.L.P.

(57) ABSTRACT

A housing is configured to receive a plug that includes an upper face, a lower face, and a front face. The housing also includes a cutout portion that traverses the upper face and the lower face, opens to the front face of the housing, extends for a length of the plug, and is formed in a direction of insertion of the plug. An opening is configured to receive the plug, which is formed on the front face of the housing and connected to the cutout so that a plug is received by the opening. A distance from the upper face to the lower face of the housing is approximately equal to a diameter of the plug.

18 Claims, 6 Drawing Sheets

(56) References Cited

U.S. PATENT DOCUMENTS

| | | | | |
|---|---|---|---|---|
| 7,387,543 | B1 * | 6/2008 | Wu | H01R 24/58 439/668 |
| 7,645,170 | B2 * | 1/2010 | Long | H01R 13/5202 439/668 |
| 7,854,633 | B2 | 12/2010 | Lynch et al. | |
| 7,887,376 | B1 * | 2/2011 | Zhang | H01R 13/6594 439/108 |
| 8,267,727 | B2 | 9/2012 | Lynch et al. | |
| 2009/0149081 | A1 * | 6/2009 | Zhu | H01R 12/57 439/668 |
| 2009/0298348 | A1 * | 12/2009 | Lu | H01R 13/15 439/668 |
| 2011/0081022 | A1 * | 4/2011 | Tamm | H01R 13/6594 381/1 |
| 2013/0029535 | A1 * | 1/2013 | Tian | H01R 12/716 439/668 |
| 2014/0293555 | A1 | 10/2014 | Cheng et al. | |

FOREIGN PATENT DOCUMENTS

| | | |
|---|---|---|
| EP | 0 800 232 A3 | 10/1997 |
| JP | 2000-340311 | 12/2000 |

* cited by examiner

FIG. 4A
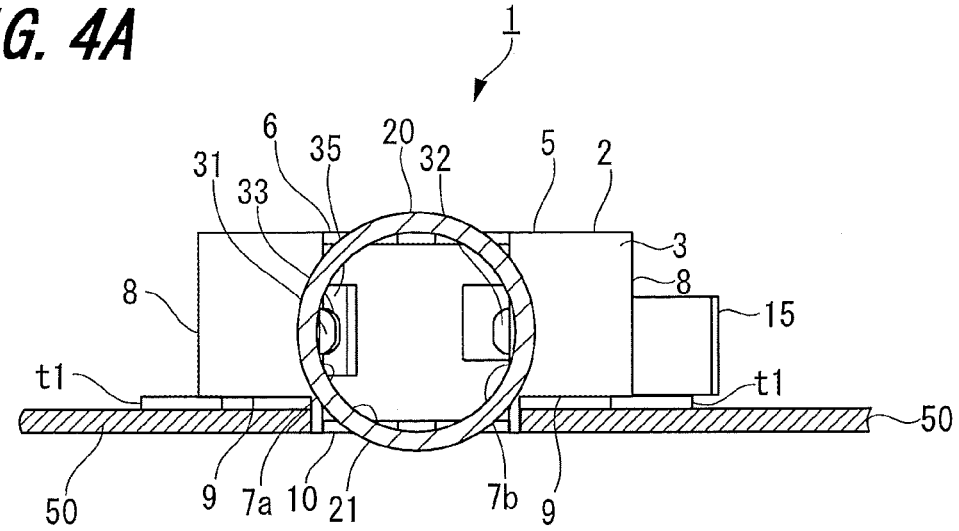
B–B
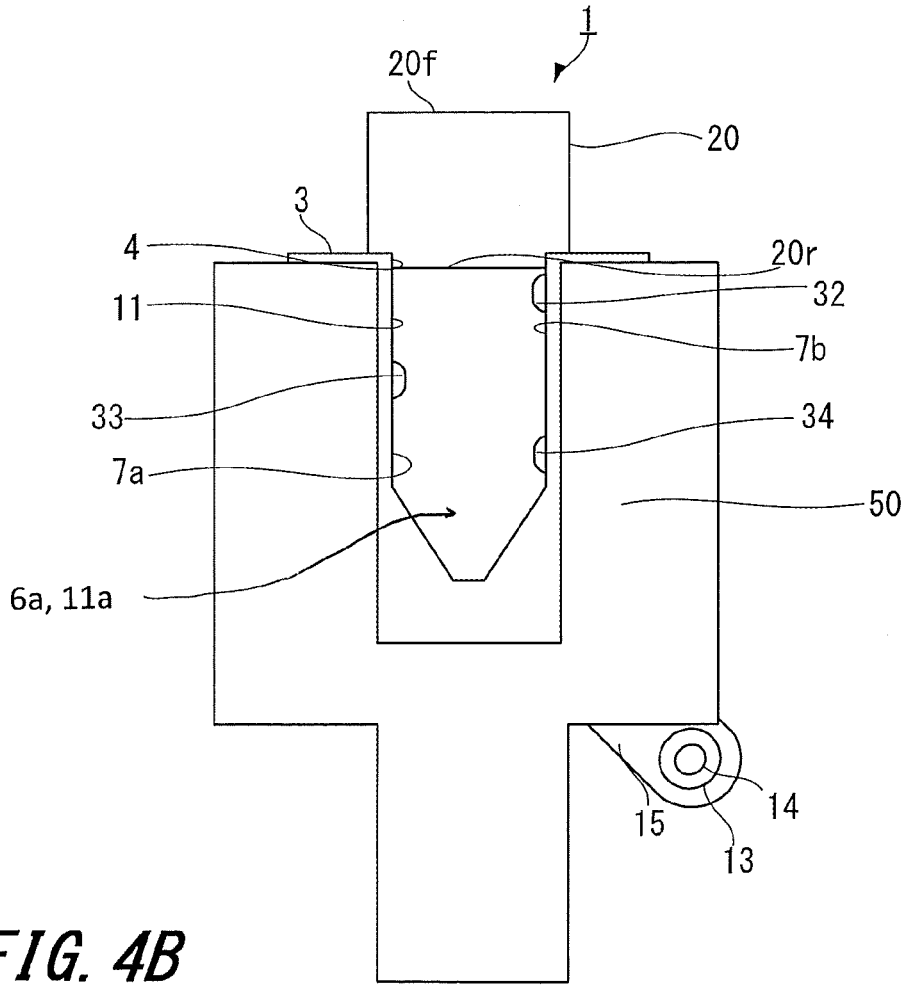
FIG. 4B

A-A

JACK SOCKET AND ELECTRONIC DEVICE

BACKGROUND

Technical Field

The present disclosure relates to a jack socket in which a plug is inserted as well as the electronic device on which the jack socket is mounted.

Description of Related Art

The "background" description provided herein is for the purpose of generally presenting the context of the disclosure. Work of the presently named inventor, to the extent it is described in this background section, as well as aspects of the description which may not otherwise qualify as prior art at the time of filing, are neither expressly nor impliedly admitted as prior art against the present disclosure.

In recent years, the reduction in thickness of electronic devices such as Smart Phones has progressed and is expected to continue. Many electronic devices are equipped with a jack socket, which can house a plug for transferring audio signals, video signals, and the like.

SUMMARY

A jack socket and device are discussed herein.

According to one exemplary embodiment, the disclosure is directed to a housing that is configured to receive a plug that includes an upper face, a lower face, and a front face. The housing also includes a cutout portion that traverses the upper face and the lower face, opens to the front face of the housing, extends for a length of the plug, and is formed in a direction of insertion of the plug. An opening is configured to receive the plug, which is formed on the front face of the housing and connected to the cutout so that a plug is received by the opening. A distance from the upper face to the lower face of the housing is approximately equal to a diameter of the plug.

According to another exemplary embodiment, the disclosure is directed to a device including a housing that is configured to receive a plug that includes an upper face, a lower face, and a front face. The housing also includes a cutout portion that traverses the upper face and the lower face, opens to the front face of the housing, extends for a length of the plug, and is formed in a direction of insertion of the plug. An opening is configured to receive the plug, which is formed on the front face of the housing and connected to the cutout so that a plug is received by the opening. A distance from the upper face to the lower face of the housing is approximately equal to a diameter of the plug. The device includes a circuit board that is electrically connected electrical contacts on the housing and a case that is attached to the housing by one or more screws.

BRIEF DESCRIPTION OF THE DRAWINGS

A more complete appreciation of this disclosure and many of the attendant advantages thereof will be readily obtained as the same becomes better understood by reference to the following detailed description when considered in connection with the accompanying drawings, wherein:

FIG. 4A is an exemplary illustration of a cross-sectional front view of a jack socket, according to certain embodiments;

FIG. 4B is an exemplary illustration of a bottom view of a jack socket, according to certain embodiments;

DETAILED DESCRIPTION

Figure 1:
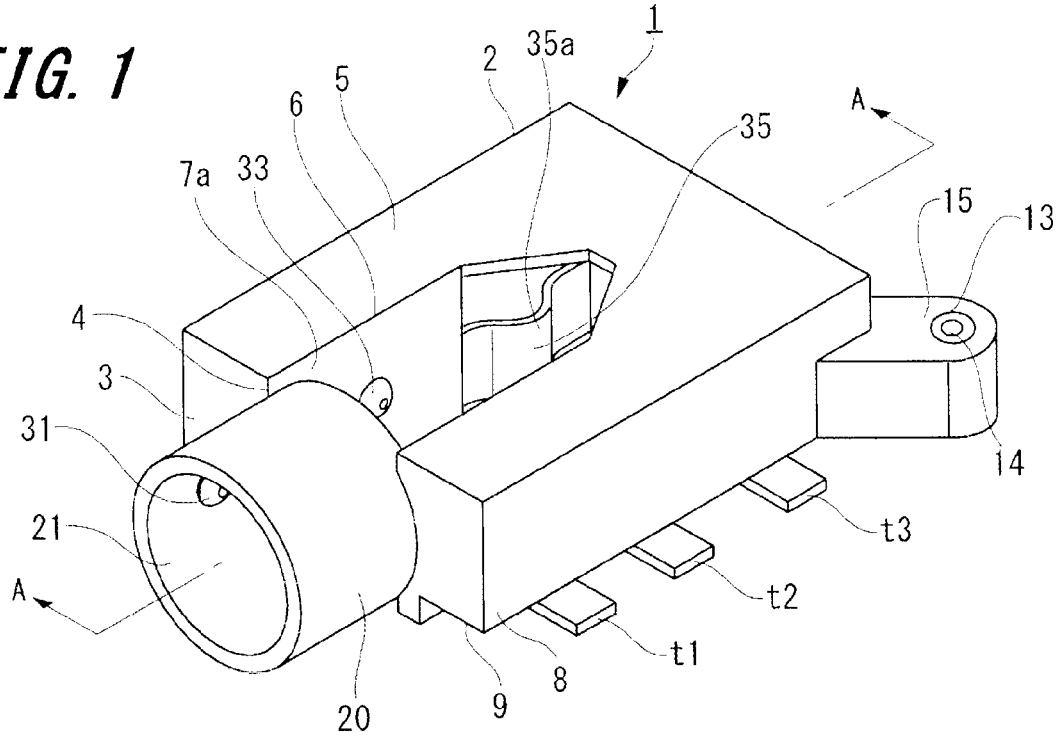
FIG. 1 is an exemplary illustration of a front right side perspective view of a jack socket, according to certain embodiments.

In the drawings, like reference numerals designate identical or corresponding parts throughout the several views. Further, as used herein, the words "a," "an" and the like generally carry a meaning of "one or more," unless stated otherwise. The drawings are generally drawn to scale unless specified otherwise or illustrating schematic structures or flowcharts.

Furthermore, the terms "approximately," "about," and similar terms generally refer to ranges that include the identified value within a margin of 20%, 10%, or preferably 5%, and any values therebetween.

The present disclosure relates to a jack socket for an electronic device that is configured to have an open space in the upper and lower surface of the jack socket housing so that a plug inserted into the jack socket housing does not come into contact with the upper and lower surface of the housing so that the outer diameter, or height, of the jack socket housing is approximately equal to the diameter of the plug. For the remainder of this description, the phrase "electronic device" is meant to describe any sort of electronic device that can be equipped with a jack socket, which can include a Smart Phone, digital music player, laptop, tablet, or the like. This phrase is not meant to limit the scope of this disclosure, but is used to merely provide a more concise description.

Figure 2:
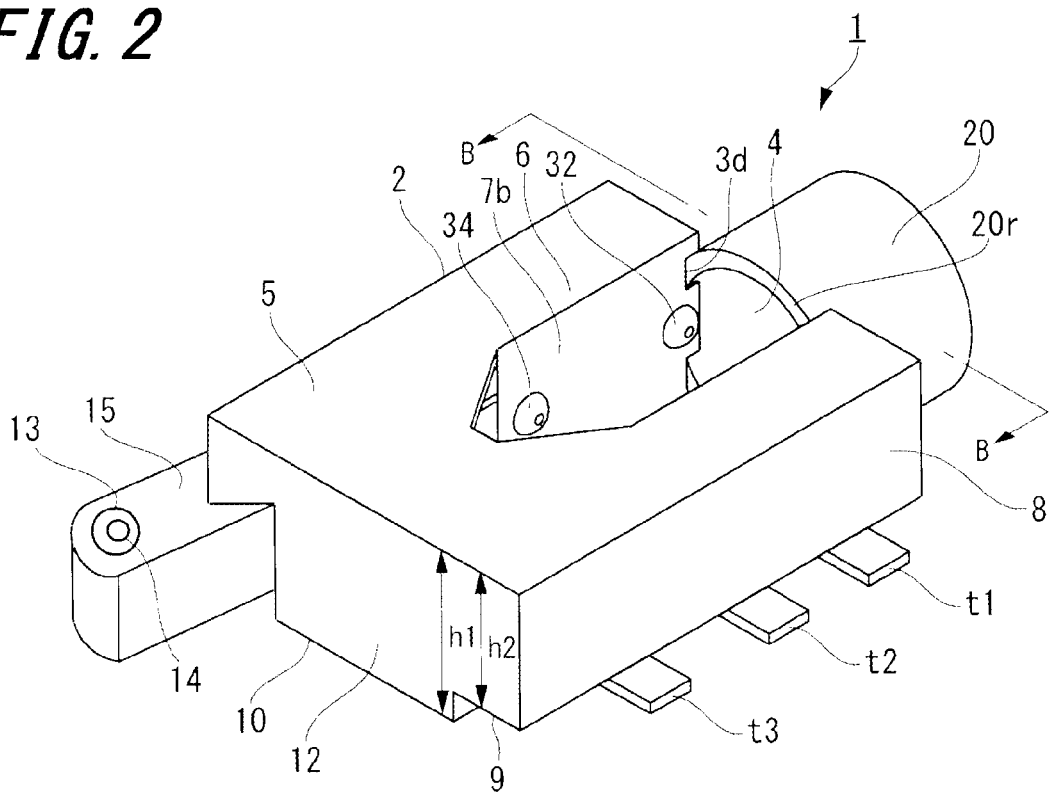
FIG. 2 is an exemplary illustration of a back right side perspective view of a jack socket, according to certain embodiments.
Figure 3:
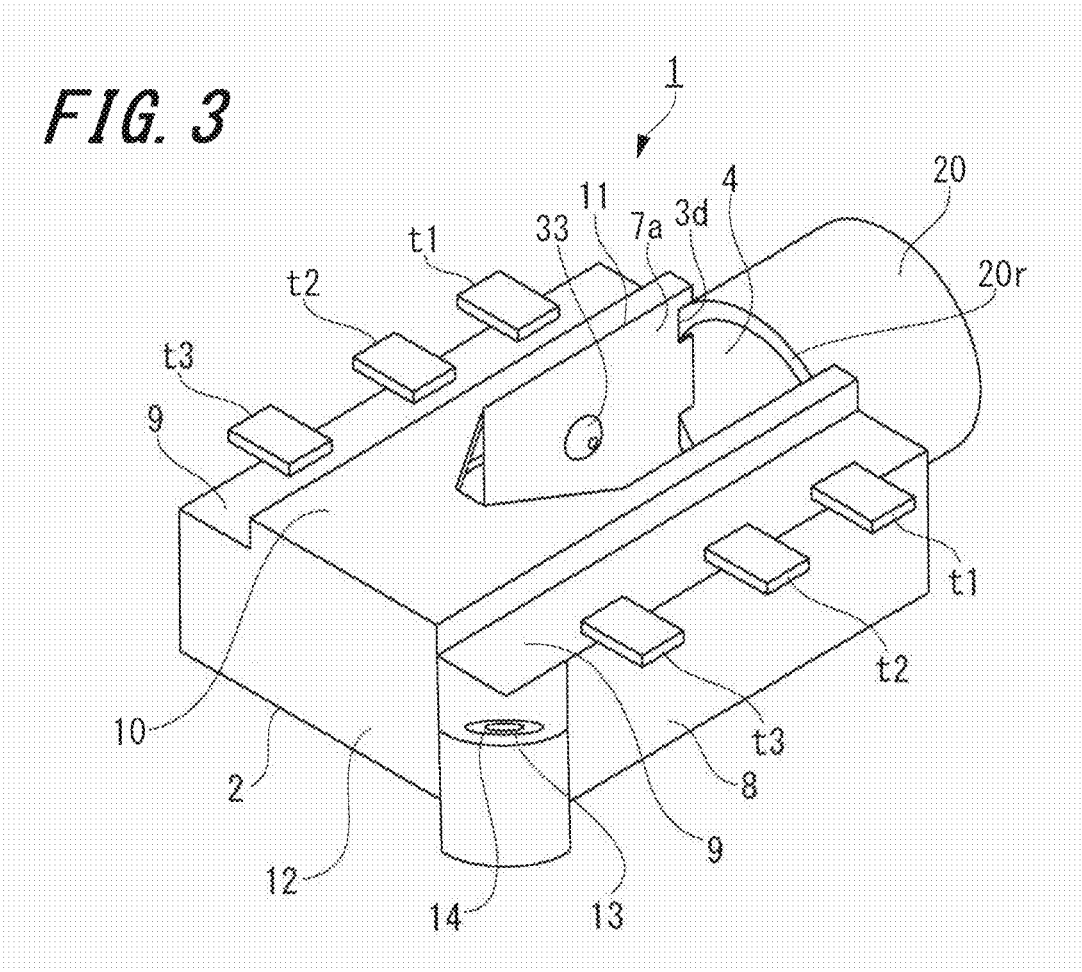
FIG. 3 is an exemplary illustration of a lower surface perspective view of a jack socket, according to certain embodiments.

FIGS. 1-3 are exemplary illustrations of perspective views of a jack socket 1, according to certain embodiments. FIG. 1 is an exemplary illustration of a front right side perspective view of the jack socket, FIG. 2 is an exemplary illustration of a back right side perspective view of the jack socket, and FIG. 3 is an exemplary illustration of a lower surface perspective view of the jack socket.

The jack socket 1 consists of a box-shaped housing 2 that is molded from a thermoplastic resin. A cutout 6 is formed into the upper surface 5 of the housing 2, and a cutout 11 is formed into the lower surface 10 of the housing 2. The cutout 6 and the cutout 11 are connected to an opening 4 on the front surface 3 of the housing 2. The cutout 6 and the cutout 11 create an open space so that the plug that is inserted into the housing 2 does not come into contact with the upper surface 5 and the lower surface 10 of the housing 2. The cutout 6, which is formed in the upper surface 5, and the cutout 11, which is formed in the lower surface 10, are connected to each other through a left inner wall 7*a* and a right inner wall 7*b*, which form an inner surface of the housing 2. To create the open space for the plug to not contact the upper surface 5 and the lower surface 10, the cutout 6 and cutout 11 are arranged in an elongated U-shape along an insertion direction of the plug and extend for a length that corresponds to the length of the plug. A tapered portion 6*a*, 11*a* is formed thereby. The opening 4 of the front surface 3 of the housing 2 is formed as an insertion port for the plug.

According to certain embodiments, a plug insertion mechanism 20 is a tubular member that is attached to the front surface 3 of the housing 2. In some aspects, the plug insertion mechanism 20 may be a cylindrical tube, as in FIGS. 1-3, but in other aspects may be a rectangular tube, a square tube, or the like. The hollow portion of the plug insertion mechanism 20 is connected to the opening 4 of the front surface of the housing 2. In certain embodiments, the plug insertion mechanism 20 is molded integrally to the housing 2. In some aspects, grooves 3*d* are formed where the left inner wall 7*a* and the right inner wall 7*b* meet the front surface 3 of the housing 2 at locations that match where a rear surface 20*r* of the plug insertion mechanism 20 can make contact with the front surface 3 of the housing 2. The rear surface 20*r* of the plug insertion mechanism 20 can be affixed to the front surface 3 of the housing 2 by inserting the rear surface 20*r* of the plug insertion mechanism 20 into the grooves 3*d*. By affixing the plug insertion mechanism 20 within the grooves 3*d*, the rear surface 20*r* is located behind the front surface 3 of the housing.

Figure 7:
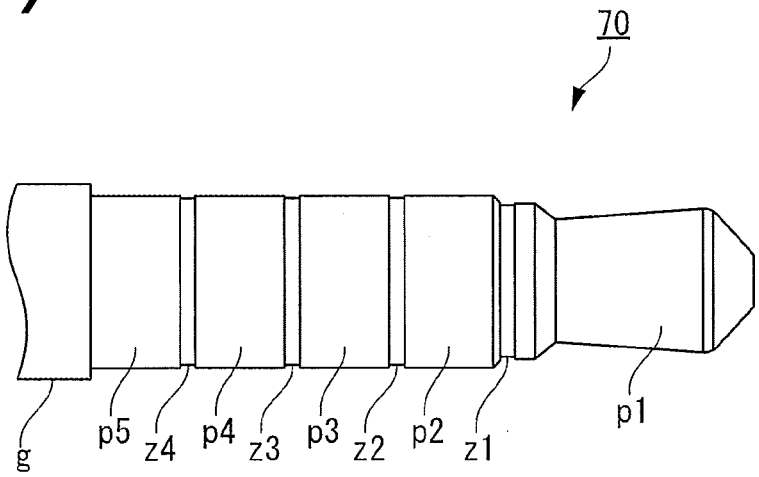
FIG. 7 is an exemplary illustration of a side view of a plug, according to certain embodiments.

In certain embodiments, as shown in FIGS. 1-3, the housing 2 of the jack socket 1 has five electrodes that correspond to the five-pole plug 70 (as shown in FIG. 7). The electrodes are arranged within the housing 2 as electrical contacts 31-35. The first through the fourth contacts, 31-34, can be composed of metallic materials molded into a circular shape with a spring like mechanism according to certain embodiments. The fifth contact 35 can be composed of malleable metallic materials molded into an elongated shape that fit within the cutout 6 and cutout 11 according to certain embodiments. The first contact, 31, is attached to an internal peripheral surface 21 of the plug insertion mechanism 20. The second contact 32 and the fourth contact 34 are attached to the right inner wall 7*b*. The third contact 33 is attached to the left inner wall 7*a*. The fifth contact 35 is attached to the left inner wall 35 within the cutout 6 and the cutout 11. The fifth contact 35 makes contact with an electrode at the side of the plug 70 with contact portion 35*a*. In addition, although the housing 2 of this example is arranged with five contacts corresponding to the five electrodes, the number of electrodes is not restricted to five. In aspects where the housing 2 has a number of contacts that is not five, the locations of the contacts within the housing may vary.

FIGS. 1-3 show level steps 9 that are formed on the corners of the housing between the lower surface 10 and the side surfaces 8 and extend from the front surface 3 to the back surface 12 of the housing 2 in order to absorb the thickness of the printed circuit board 50 (as shown in FIG. 4) when assembled. By adding the level steps 9 in the housing 2, there is a height h2 from the level steps 9 to the upper surface 5 that is less than a height h1 from the lower surface 10 to the upper surface 5. The height of the level steps 9 the difference between h1 and h2, which is h1-h2. The width of the level steps 9 that extends from the side surfaces 8 is formed that the width of the level steps 9 does not reach the edge of the cutout 6 or the cutout 11.

In certain embodiments, six terminals are arranged in two sets of terminals, t1, t2, and t3, and are arranged on the level steps 9 parallel to the lower surface 10. The terminals t1-t3 are arranged sequentially from the front surface 3 to the back surface 12 of the housing 2. The two sets of terminals t1-t3 arranged on the level steps 9 are suitably connected to the contacts 31-35 within the housing 2.

The jack socket 1 includes an attachment arm 15 that is connected to the housing 2 at a rear corner where the back surface 12 and a side surface 8 of the housing 2 meet. In some aspects, at least one screw-hole 14 is arranged on an upper surface and lower surface of the attachment arm 15 for mounting the jack socket 1 to an electronic device. A concentric outer hole 13 is formed on the upper surface of the attachment arm 15 around the screw-hole 14 that corresponds to the size of an external thread of a screw so that the external thread does not break the plane of the upper surface of the attachment arm 15 when the screw is inserted into the screw-hole 14.

FIG. 4A is an exemplary illustration of a cross-sectional front view of a jack socket 1, according to certain embodiments. The cross-sectional front view of the jack socket 1 is taken across the B-B axis (as shown in FIG. 2). The housing 2 of the jack socket 1 is mounted to the printed circuit board 50. Terminals t1-t3 are attached to the level steps 9 on both sides of the housing 2. When the housing 2 is mounted to the printed circuit board 50, the thickness of the circuit board 50 is absorbed by the height of the level steps 9, which is h1-h2. The housing 2 can be fixed to a case of an electronic device with at least one screw at a location that is based on the location of the attachment arm 15 with at least one screw-hole 14. A lower surface of the attachment arm 15 is equal to level step 9 to ensure that the housing 2 is affixed to the case of the electronic device without adding any additional thickness to the electronic device.

FIG. 4B is an exemplary illustration of a bottom view of a jack socket 1, according to certain embodiments. The lower surface 10 of the jack socket 1 is mounted to the printed circuit board 50, and a width of the printed circuitry board 50 on both sides of the cutout 6 and cutout 11 extends past an outermost point of the terminals t1-t3. In addition, the attachment arm 15 with the screw-hole 14 extends outside the area covered by the printed circuit board 15 so that the housing 2 can be fixed to the case of the electronic device via the at least one screw.

Figure 5:
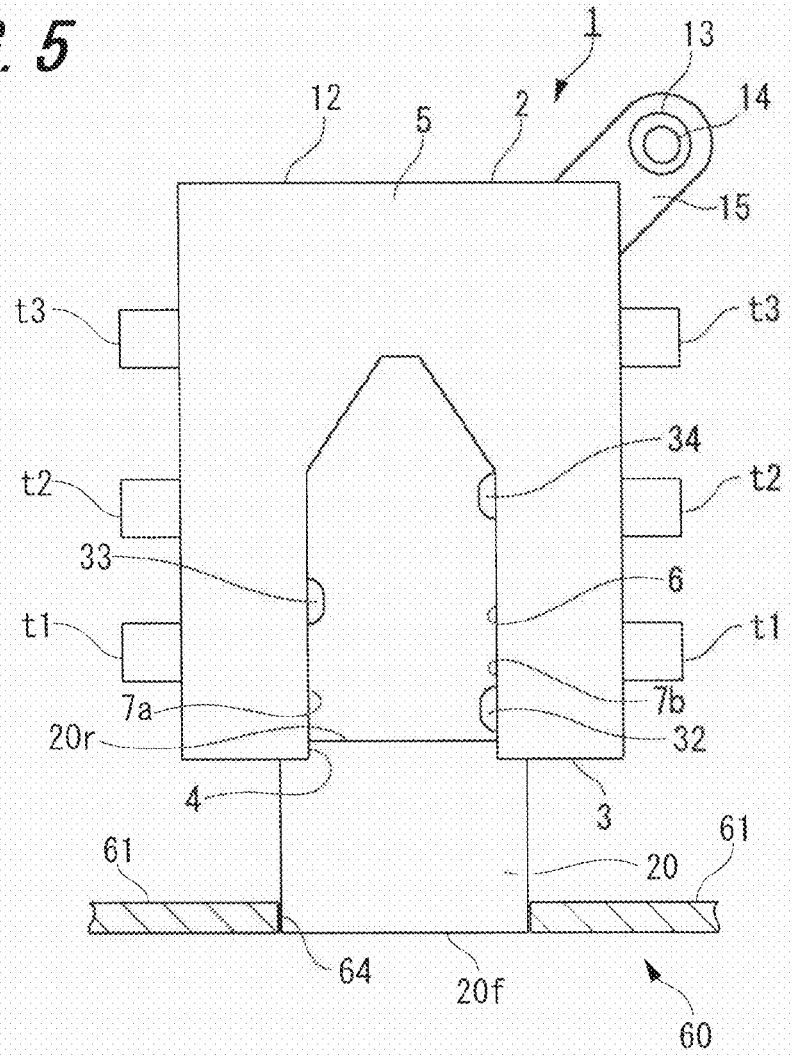
FIG. 5 is an exemplary illustration of a top view of a jack socket, according to certain embodiments.

FIG. 5 is an exemplary illustration of a top view of a jack socket according to certain embodiments. The plug insertion mechanism 20 is a tubular member that is attached to the housing 2 so that it lines up with the opening 4 on the front face 3 of the housing 2 as well as cutout 6 and cutout 11. The plug insertion mechanism 20 gives additional structural support to the front surface 3 on either side of the opening 4 of the housing. For example, the plug insertion mechanism 20 is attached to the housing 2 via a molding process, reflow soldering process, or the like, which prevents the deformation of the housing 2 through repeated insertions and withdrawals of the plug 70. The jack socket 1 is mounted to the electronic device 60 so that the front face 20*f* of the plug insertion mechanism 20 is flush with an annular hole 64 formed in the case 61. By mounting the jack socket 1 in this way, when the electronic device 60 is viewed down the axis of the plug insertion mechanism 20, the front face 20*f* can be viewed just inside the annular hole 64.

Figure 6:
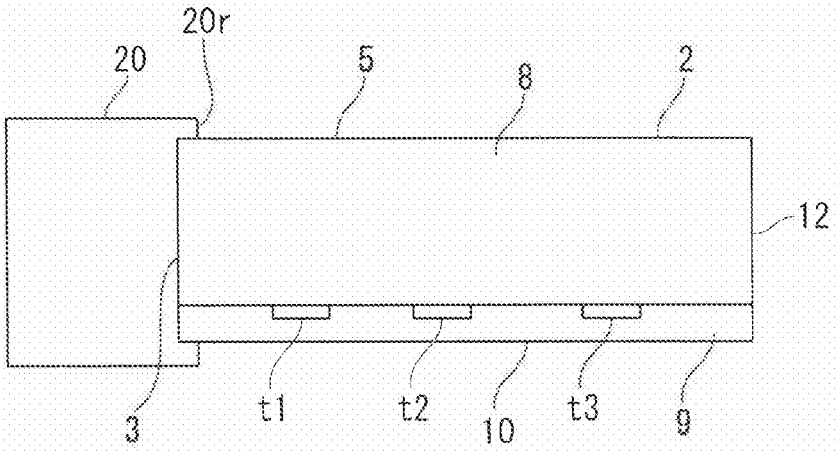
FIG. 6 is an exemplary illustration of a side view of a jack socket, according to certain embodiments.

FIG. 6 is an exemplary illustration of a side view of a jack socket according to certain embodiments. The side view of the jack socket 1 displays the difference in height between the lower surface of the housing 10 and the level steps 9 that is able to absorb the height of the printable circuit board 50.

The side view also displays that the rear surface 20*r* of the plug insertion mechanism 20 is located behind the front surface 3 of the housing 2.

FIG. 7 is an exemplary illustration of a side view of a plug according to certain embodiments. The plug 70 in this example is a 5 pole jack socket plug. The plug 70 contains a grip g and a main body. The main body is composed of the chip electrode p1, the first ring electrode p2, the second ring electrode p3, the third ring electrode p4, and the sleeve electrode p5 that are arranged sequentially from the front end of the plug 70. In addition, insulation rings z1, z2, z3, and z4 are sequentially arranged between the electrodes p1, p2, p3, p4, and p5.

Figure 8:
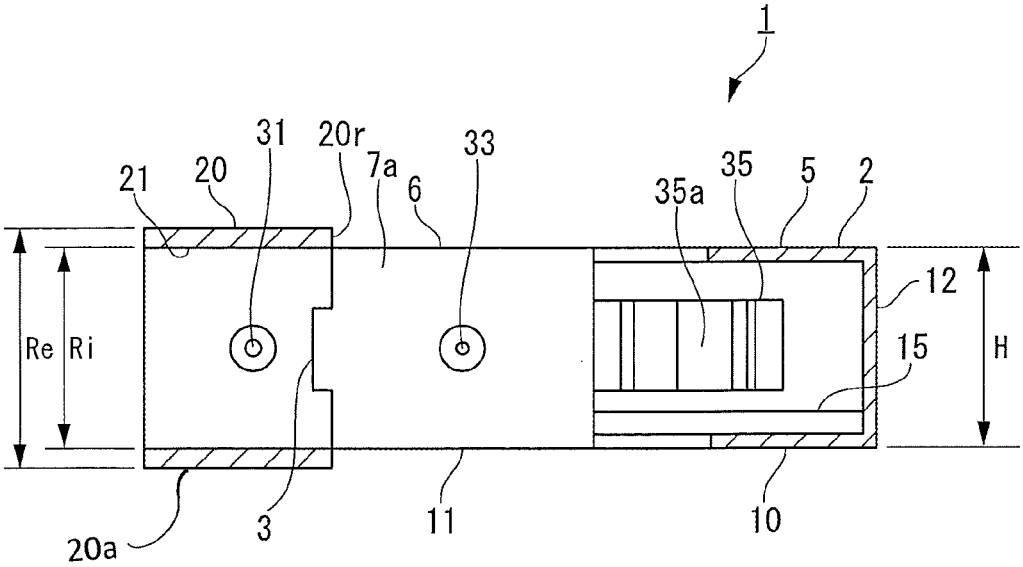
FIG. 8 is an exemplary illustration of a cross-sectional side view of a jack socket, according to certain embodiments.

FIG. 8 is an exemplary illustration of a cross-sectional side view of a jack socket 1 according to certain embodiments. The cross-sectional side view of the jack socket 1 is taken across the A-A axis (as shown in FIG. 1). Cutout 6 is formed into the upper surface 5 of the housing 2, and cutout 11 is formed into the lower surface 10 of the housing 2. The housing 2 of the jack socket 1 is designed so that the height H of the upper surface 5 to the lower surface 10 is approximately equal to the diameter of the plug 70 so that when the plug 70 is inserted into the opening 4 of the front surface 3 of the housing 2, it does not make contact with the upper surface 5 and lower surface 10 of the housing 2. In addition, when the plug 70 is inserted into the housing 2, the plug 70 can be exposed at the location of the cutout 6 and cutout 11.

By making the height H of the housing 2 approximately equal to the diameter of the plug 70, the thickness of the jack socket 1 can be reduced. For example, if the diameter of the plug 70 is approximately equal to 3.5+/−0.05 mm (millimeters), the height H of the housing 2 can be manufactured to be approximately equal to 3.5+/−0.05 mm (millimeters). According to certain embodiments, a diameter Ri of the internal surface 21 of the plug insertion mechanism 20 can be set to be approximately equal to 3.55 mm+α. In this embodiment, a is a minimum value that can be added to the diameter Ri to ensure that the plug 70 can be inserted smoothly into the jack socket 1. In addition, a diameter Re corresponds to the diameter of the outer peripheral surface of the plug insertion mechanism 20. In some implementations, the diameter Re of the outer peripheral surface 20*a* of the plug insertion mechanism 20 can be the thickest portion of the jack socket 1.

Figure 9:
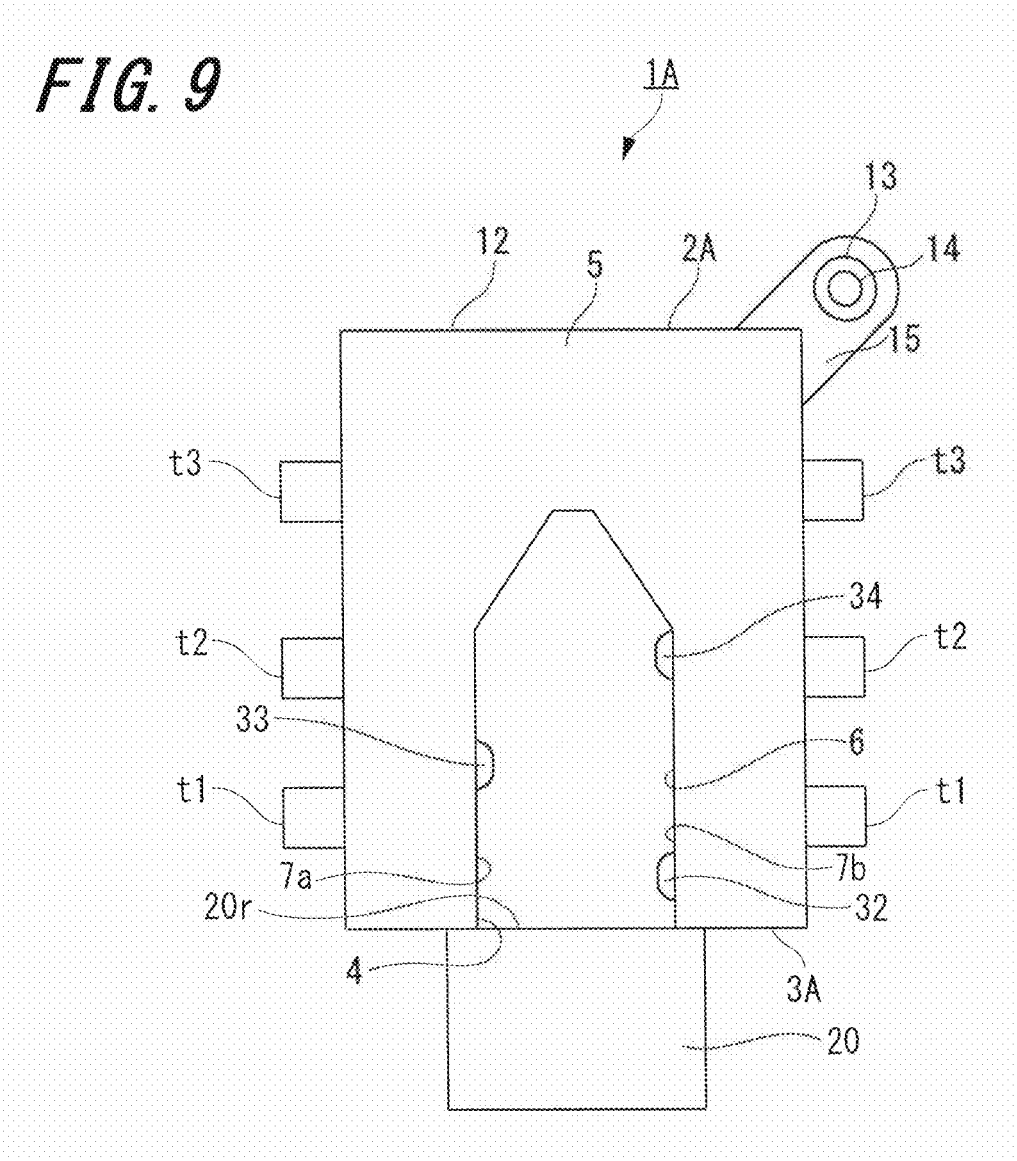
FIG. 9 is an exemplary illustration of a top view of a jack socket, according to a second embodiment.

FIG. 9 is a second exemplary illustration of a top view of a jack socket according to a second embodiment. According to this embodiment, jack socket 1A is assembled so that the rear surface 20*r* of the plug insertion mechanism 20 is attached to the front surface 3A of the housing 2A. More specifically, the relative location of the rear surface 20*r* of the plug insertion mechanism 20 compared to the jack socket 1A as a whole is equal to the location of the front surface 3A of the housing 2A. In certain embodiments, the length of the jack housing 1A from the front face 20*f* of the plug insertion mechanism 20 can be changed by adjusting the length of the plug insertion mechanism 20.

Obviously, numerous modifications and variations of the present disclosure are possible in light of the above teachings. It is therefore to be understood that within the scope of the appended claims, the invention may be practiced otherwise than as specifically described herein. For example, advantageous results may be achieved if components in the disclosed systems were combined in a different manner, or if the components were replaced or supplemented by other components.

The above disclosure also encompasses the embodiments noted below.

(1) A housing configured to receive a plug, the housing including: an upper face; a lower face; a front face; a cutout portion that traverses the upper face and the lower face, opens to the front face of the housing, extends for a length of the plug, and is formed in a direction of insertion of the plug; and an opening configured to receive the plug, the opening formed on the front face of the housing and connected to the cutout, wherein a plug is received by the opening and a distance from the upper face to the lower face is approximately equal to a diameter of the plug.

(2) The housing of (1), further including a tubular member for inserting the plug arranged on the front face of the housing.

(3) The housing of (1) or (2), wherein one or more grooves are formed at one or more locations where the front surface of the housing meets the inner surface of the housing for affixing the tubular member to the housing.

(4) The housing of any one of (1) to (3), wherein the tubular member is attached to the front face of the housing via the one or more grooves so that a rear face of the tubular member is located behind the front face of the housing.

(5) The housing of any one of (1) to (4), wherein the tubular member is attached to the front face of the housing so that the rear face of the tubular member is at an equal location to the front face of the housing.

(6) The housing of any one of (1) to (5), further including two steps which are formed between a back face of the housing and a front face of the housing and on side surfaces of the housing for absorbing a thickness of a circuit board.

(7) The housing of any one of (1) to (6), wherein the steps are formed at a height that is less than a height from the lower surface to the upper surface of the housing.

(8) The housing of any one of (1) to (7), wherein the tubular member has an outer surface with a diameter that is a widest dimension of the housing.

(9) The housing of any one of (1) to (8), wherein the tubular member has an inner surface with a second smaller diameter that is large enough for the plug to be inserted smoothly.

(10) The housing of any one of (1) to (9), further comprising an attachment arm at a rear corner of the housing that receives a screw through at least one screw-hole to fix the housing to a circuit board.

(11) A device, including: a housing configured to receive a plug, the housing including: an upper face, a lower face, a front face, a cutout portion that traverses the upper face and the lower face, opens to the front face of the housing, extends for a length of the plug, and is formed in a direction of insertion of the plug, and an opening configured to receive the plug, the opening formed on the front face of the housing and connected to the cutout, wherein a plug is received by the opening and a distance from the upper face to the lower face is approximately equal to a diameter of the plug; a circuit board that is electrically connected to a plurality of electrical contacts on the housing; and a case that is attached to the housing by one or more screws.

(12) The device of (11), the housing further including a tubular member for inserting the plug arranged on the front face of the housing.

(13) The device of (11) or (12), wherein one or more grooves are formed at one or more locations where the front surface of the housing meets the inner surface of the housing for affixing the tubular member to the housing.

(14) The device of any one of (11) to (13), wherein the tubular member is attached to the front face of the housing via the one or more grooves so that a rear face of the tubular member is located behind the front face of the housing.

(15) The device of any one of (11) to (14), wherein the tubular member is attached to the front face of the housing so that the rear face of the tubular member is at an equal location to the front face of the housing.

(16) The device of any one of (11) to (15), the housing further including two steps which are formed between a back face of the housing and a front face of the housing and on side surfaces of the housing for absorbing a thickness of the circuit board.

(17) The device of any one of (11) to (16), wherein the steps are formed at a height that is less than a height from the lower surface to the upper surface of the housing.

(18) The device of any one of (11) to (17), wherein the tubular member has an outer surface with a diameter that is a widest dimension of the housing.

(19) The device of any one of (11) to (18), wherein the tubular member has an inner surface with a second smaller diameter that is large enough for the plug to be inserted smoothly.

(20) The device of any one of (11) to (19), further comprising an attachment arm at a rear corner of the housing that receives a screw through at least one screw-hole to fix the housing to the circuit board.

The invention claimed is:

1. A housing configured to receive a plug and to be installed on a circuit board, the housing comprising:

a body shaped to define an upper face;

a lower face; a front face;

a cutout portion that traverses the upper face and the lower face, opens to the front face of the housing, extends for a length of the plug, and is formed in a direction of insertion of the plug, the cutout portion having a front end portion and a rear end portion remote from the front face, the rear end portion forms with tapered portions for receiving a front end of the plug; and a plug insertion having an opening configured to receive the plug, the plug insertion formed on the front face of the housing and connected to the cutout portion; and a tubular member for inserting the plug.

2. The housing of claim 1, wherein the cutout portion has inner walls forming an inner surface, and wherein one or more grooves are formed for affixing the tubular member to the body.

3. The housing of claim 2, wherein the tubular member is attached to the front face via the one or more grooves so that a rear face of the tubular member is located behind the front face.

4. The housing of claim 1, wherein the tubular member has a rear face and is attached to the front face of the body so that the rear face of the tubular member is located at the front face of the body.

5. The housing of claim 1, wherein the body is shaped to have a back face, side surfaces, and two steps which are formed between the back face of the body and the front face of the body and on the side surfaces of the body for absorbing a thickness of a circuit board.

6. The housing of claim 5, wherein:

a height from the lower face to the upper face of the body defines a first height h1;

a height from the steps to the upper face of the body defines a second height h2; and the second height h2 is less than the first height h1.

7. The housing of claim 1, wherein the tubular member has an outer surface with a diameter that defines a thickest portion of the body.

8. The housing of claim 7, wherein the tubular member has an inner surface with a second smaller diameter that is large enough for the plug to be inserted smoothly.

9. The housing of claim 1, further comprising an attachment arm at a rear corner of the housing, the attachment arm having at least one screw-hole to fix the housing to a circuit board.

10. A device, comprising:

a housing configured to receive a plug, the housing comprising:

a body shaped to define an upper face, a lower face, a front face, a cutout portion that traverses the upper face and the lower face, opens to the front face of the housing, extends for a length of the plug, and is formed in a direction of insertion of the plug, the cutout portion having a front end portion and a rear end portion remote from the front face, the rear end portion forms with tapered portions for receiving a front end of the plug, and a plug insertion having an opening configured to receive the plug, the plug insertion formed on the front face of the housing and connected to the cutout portion; and a tubular member for inserting the plug;

a circuit board that is electrically connected to a plurality of electrical contacts on the housing; and a case that is attached to the housing.

11. The device of claim 10, wherein the cutout portion has inner walls forming an inner surface, and wherein one or more grooves are formed for affixing the tubular member to the body.

12. The device of claim 11, wherein the tubular member is attached to the front face via the one or more grooves so that a rear face of the tubular member is located behind the front face.

13. The device of claim 10, wherein the tubular member has a rear face and is attached to the front face of the body so that the rear face of the tubular member is located at the front face of the body.

14. The device of claim 10, wherein the body is shaped to have a back face, side surfaces, and two steps which are formed between the back face of the body and the front face of the body and on the side surfaces of the body for absorbing a thickness of the circuit board.

15. The device of claim 14, wherein:

a height from the lower face to the upper face of the body defines a first height h1;

a height from the steps to the upper face of the body defines a second height h2; and the second height h2 is less than the first height h1.

16. The device of claim 10, wherein the tubular member has an outer surface with a diameter that defines a thickest portion of the body.

17. The device of claim 16, wherein the tubular member has an inner surface with a second smaller diameter that is large enough for the plug to be inserted smoothly.

18. The device of claim 10, further comprising an attachment arm at a rear corner of the housing, the attachment arm having at least one screw-hole to fix the housing to the circuit board.

* * * * *